US012716214B2

(12) United States Patent
Dahan et al.

(10) Patent No.: US 12,716,214 B2
(45) Date of Patent: Aug. 25, 2026

(54) LIQUID DISPENSING UNIT AND LIQUID DISPENSING APPARATUS

(71) Applicant: UNITO SMART TECHNOLOGIES LIMITED, Tsuen Wan (HK)

(72) Inventors: Avi Dahan, Rishon Lezion (IL); Yoni Dahan, Rishon Lezion (IL)

(73) Assignee: UNITO SMART TECHNOLOGIES LIMITED, Tsuen Wan NT (HK)

( * ) Notice: Subject to any disclaimer, the term of this patent is extended or adjusted under 35 U.S.C. 154(b) by 0 days.

(21) Appl. No.: 19/093,404

(22) Filed: Mar. 28, 2025

(65) Prior Publication Data

US 2025/0314051 A1 Oct. 9, 2025

(30) Foreign Application Priority Data

Apr. 8, 2024 (EP) ..... 24169017

(51) Int. Cl.
*E03C 1/04* (2006.01)

(52) U.S. Cl.
CPC ..... *E03C 1/04* (2013.01); *E03C 1/0404* (2013.01); *E03C 2001/0415* (2013.01)

(58) Field of Classification Search
CPC .. E03C 1/04; E03C 1/0404; E03C 2001/0415; E03C 2201/40
See application file for complete search history.

(56) References Cited

U.S. PATENT DOCUMENTS 7,328,717 B1 * 2/2008 Hertz ..... E03C 1/021 4/654
9,840,831 B1 * 12/2017 Esche ..... E03C 1/0404
10,072,402 B2 * 9/2018 Esche ..... E03C 1/0404
10,184,231 B2 * 1/2019 Pitsch ..... E03C 1/0408
2022/0163140 A1 * 5/2022 Cheng ..... B65H 51/10
2023/0132961 A1 5/2023 Zhou et al.
2023/0322542 A1 10/2023 Kang

FOREIGN PATENT DOCUMENTS

CN 110924480 A 3/2020
DE 102018218702 A1 4/2020

OTHER PUBLICATIONS

European Application No. Application No. EP24169017.1, Extended European Search Report Mailed on Oct. 15, 2024, 5 pages.

* cited by examiner

*Primary Examiner* — John Bastianelli

(74) *Attorney, Agent, or Firm* — Kilpatrick Townsend & Stockton LLP

(57) ABSTRACT

Disclosed is a liquid dispensing unit with a pull-out dispensing nozzle configured to be moved in a pull-out direction and opposite thereto relative to a basis element, in particular a faucet, of the liquid dispensing unit. The liquid dispending unit also includes a flexible conduit that fluidically connects the pull-out dispensing nozzle to a dispensing outlet of a liquid dispensing apparatus, and a retraction mechanism operationally connected to the flexible conduit, the retraction mechanism including a retraction force generation element and a holding unit configured to be mounted to a holding structure, the holding unit having adjustment means configured to adjust a mounting position of the holding unit relative to the holding structure and/or to adjust a connecting position between the holding unit and the retraction force generation element.

14 Claims, 5 Drawing Sheets

LIQUID DISPENSING UNIT AND LIQUID DISPENSING APPARATUS

CROSS REFERENCE TO RELATED APPLICATION

Figure 1A:
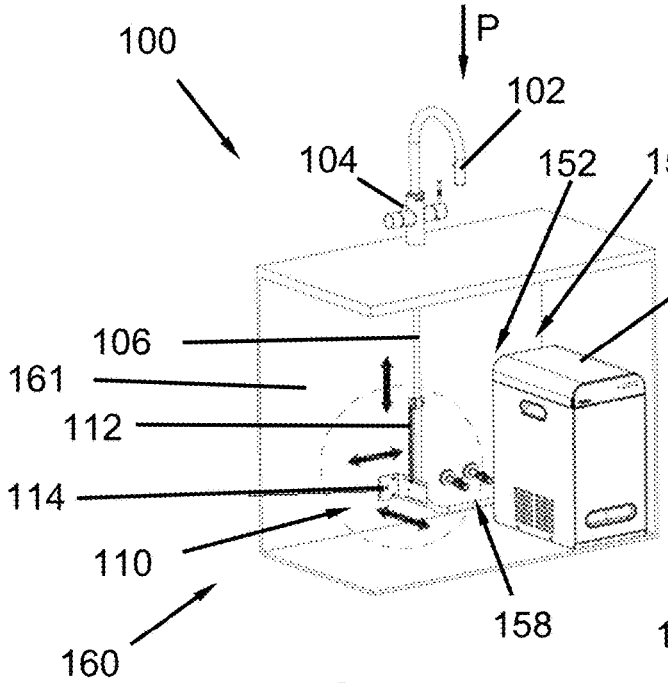

This application claims priority to European Patent Application No. 24169017.1, filed in Europe on Apr. 8, 2024, the entire contents of which are hereby incorporated herein by this reference.

DESCRIPTION

The present invention refers to a liquid dispensing unit which is configured to dispense liquid delivered from a dispensing outlet of a liquid dispensing apparatus to an outside of the liquid dispensing unit. Furthermore, the present invention refers to a liquid dispensing apparatus, comprising the liquid dispensing unit.

Liquid dispensing apparatuses are generally known and are often used for dispensing treated or non-treated liquids, such as filtered or non-filtered hot or cold water or beverages, in particular in conjunction with household applications, such as faucets of kitchens or the like. However, already at this point it should be noted that although the present invention is described below in part with reference to the dispensing of water and beverages via faucets of kitchens, no limitations of the invention can be derived therefrom.

To be able to dispense liquid delivered from the dispensing outlet of the liquid dispensing apparatus in a flexible manner, it is known to use a pull-out dispensing nozzle which is configured to be moved in a pull-out direction and opposite thereto relative to a basis element, in particular a faucet, of the liquid dispensing unit. To fluidically connect the pull-out dispensing nozzle to the dispensing outlet of the liquid dispensing apparatus, it is known to use a flexible conduit, such as a flexible hose, which ensures that the pull-out dispensing nozzle may be pulled out in the pull-out direction by a user of the liquid dispensing unit by a predetermined amount which is sufficient for a respective purpose of the liquid dispensing unit. If the liquid dispensing unit is used in kitchens, for example, the predetermined amount may be selected such that objects, such as pots, porcelain, glass and the like, which may be arranged near the pull-out dispensing nozzle, may be cleaned or filled with water or the like in a comfortable manner.

After a user has finished a respective cleaning or filling operation or the like and intends to transfer the pull-out dispensing nozzle in a retracted state, the movement of the pull-out dispensing nozzle opposite to the pull-out direction may be assisted by a retraction mechanism which is operationally connected to the flexible conduit and configured to apply a retraction force to the flexible conduit, in response to the pull-out dispensing nozzle being moved in the pull-out direction relative to the basis element.

To generate the retraction force, known retraction mechanism often comprise a retraction force generation element in form of a ballast element which may be connected to the flexible conduit and configured to generate the retraction force simply through the effect of gravity. However, if the ballast element is arranged within a kitchen cabinet or the like and/or under a sink at which the liquid dispensing unit is mounted, a movement space required for the ballast element to follow the movement of the pull-out dispensing nozzle in the pull-out direction and opposite thereto may be very limited. As a result, a case may occur in which the ballast element may unintentionally collide or interfere with other objects in the kitchen cabinet and/or under the sink what may lead to corresponding malfunctions of the retraction mechanism. If the liquid dispensing unit is used in combination with a liquid dispensing apparatus that comprises a liquid supply system for supplying different kinds of liquid, such as cold water, warm water, filtered water and/or non-filtered water and/or even beverages, such as soft drinks or the like, the movement space may be further limited so that the risk of malfunctions of the retraction mechanism may be even higher.

It is therefore an object of the present invention to provide a liquid dispensing unit which is capable to remedy those situations and to counter at least some of the above-mentioned drawbacks.

According to the present invention this object is solved by a liquid dispensing unit which is configured to dispense liquid delivered from a dispensing outlet, in particular of a liquid supply system, of a liquid dispensing apparatus to an outside of the liquid dispensing unit, the liquid dispensing unit comprising:

- a pull-out dispensing nozzle which is configured to be moved in a pull-out direction and opposite thereto relative to a basis element, in particular a faucet, of the liquid dispensing unit,
- a flexible conduit which is designed and intended to fluidically connect the pull-out dispensing nozzle to the dispensing outlet of the liquid dispensing apparatus,
- a retraction mechanism which is operationally connected to the flexible conduit and configured to apply a retraction force to the flexible conduit, in response to the pull-out dispensing nozzle being moved in the pull-out direction relative to the basis element, wherein the retraction mechanism comprises:
- a retraction force generation element, which is configured to generate the retraction force to be applied to the flexible conduit, and
- a holding unit which is configured to be connected to the retraction force generation element and configured to be mounted to a holding structure, wherein the holding unit comprises adjustment means configured to adjust a mounting position of the holding unit relative to the holding structure and/or to adjust a connecting position between the holding unit and the retraction force generation element.

According to the present invention, via the adjustment means of the holding unit, it is possible to adjust the mounting position of the holding unit relative to the holding structure and/or to adjust the connecting position between the holding unit and the retraction force generation element. As a consequence, the mounting position of the holding unit and/or the connecting position between the holding unit and the retraction force generation element may be adapted to a respective use case of the liquid dispensing unit. Thus, unintentional collisions or interference between the retraction force generation element and other objects arranged near the retraction force generation element, for example, may be avoided to ensure a smooth operation of the retraction mechanism of the liquid dispensing unit. Furthermore, by the adjustment means it is preferably possible to adjust a direction of the retraction force generated by the retraction force generation element in conformity with the respective use case, so that the direction of the retraction force may be adapted to a desired direction and is not limited to the direction of the force of gravity, as in the case of the above-mentioned ballast element.

Preferably the retraction force generated by the retraction force generation element is adjustable. Thus, the retraction force may be adapted to specific needs in conformity with the respective use case of the retraction mechanism.

Furthermore, the retraction mechanism according to the present invention has the advantage that the retraction force of the retraction force generation element is preferably applied to the flexible conduit only in one direction, which direction is preferably substantially opposite to the pull-out direction. Thus, preferably only one end of the flexible conduit which is connected to the pull-out dispensing nozzle is loaded with the retraction force. However, in known retraction mechanisms comprising a retraction force generation element in form of a ballast element which may be connected to the flexible conduit and configured to generate the retraction force simply through the effect of gravity, usually both ends of the flexible conduit are permanently loaded with the retraction force generated by the ballast element, i.e. also an end of the flexible conduit which is connected to the liquid supply system.

The holding structure is preferably not part of the liquid dispensing unit. The holding structure may comprise or be a bottom portion or a wall portion or a top portion of a kitchen cabinet or the like. The bottom portion and/or the top portion may comprise a substantially horizontal surface to which the holding unit may be configured to be mounted and/or the wall portion may comprise a substantially vertical surface to which the holding unit may be configured to be mounted.

For adjusting the mounting position of the holding unit relative to the holding structure and/or the connecting position between the holding unit and the retraction force generation element, according to a preferred embodiment, the adjustment means may comprise a plurality of mounting holes, wherein preferably the mounting holes may be arranged at different positions on the holding unit and/or may be formed as elongated mounting holes. In this case, the holding unit may be fixed to the holding structure via one or more fixation elements, such as fixation screws or the like. However, in addition or as an alternative, the adjustment means may also comprise a sliding mechanism or the like which is configured to allow a relative movement between the holding unit and the holding structure, such as a kitchen cabinet, and/or a relative movement between the holding unit and the retraction force generation element. In this context, the sliding mechanism may be configured such that a relative position between the holding unit and the holding structure and/or the holding unit and the retraction force generation element may be fixed by a fixation mechanism, such as a fixation lever or the like, when the relative position corresponds to a position suitable for operation of the liquid dispensing unit.

To further improve the smooth operation of the retraction mechanism of the liquid dispensing unit of the present invention, in particular in terms of the movement of the pull-out dispensing nozzle in the pull-out direction and opposite thereto, according to a further embodiment, the retraction mechanism may further comprise a retraction force transmitting element which on its one end is connected to the retraction force generation element and on its other end is coupled to the flexible conduit, wherein the retraction force transmitting element may be configured to transmit the retraction force generated by the retraction force generation element to the flexible conduit. Preferably, the retraction force transmitting element may be made of a flexible material, such as a flexible wire and/or an elastomer, such as rubber, or the like. If the retraction force transmitting element is made of such a flexible material, the flexible conduit, in particular the flexible hose, may also be allowed to rotate relative to the retraction force transmitting element without damaging the flexible conduit and/or the retraction force transmitting element. Further, by arranging the retraction force transmitting element between the retraction force generation element and the flexible conduit, the retraction force generation element may be arranged at a position in which it is particularly protected against unintentional collisions or interference between the retraction force generation element and other objects arranged near the retraction mechanism. Furthermore, the flexible conduit may be guided in a desired direction, as the direction of the retraction force may be adapted with even more flexibility depending on the respective use case of the liquid dispensing unit. In addition, it is possible to connect the retraction force transmitting element with a retraction force deflection element, such as a deflection roller or the like, to change a direction of the retraction force generated by the retraction force generation element.

According to a further embodiment, the retraction force generation element may comprise or may be formed as a spring, in particular a linear spring or a coil spring, wherein one end of the spring may be coupled to the flexible conduit or a part connected thereto, in particular the retraction force transmitting element, and the other end of the spring may be coupled to the holding unit. By using a spring, the retraction force may be selectively adapted to specific preferences of the user of the liquid dispensing unit. Furthermore, the spring may be configured to generate a force that increases linear or non-linear with increasing movement of the pull-out dispensing nozzle in the pull-out direction relative to the basis element.

In addition or as an alternative, to further protect the retraction force generation element from external effects that may disrupt smooth operation of the retraction mechanism, the liquid dispensing unit may further comprise a retraction force generation element housing which is configured to house the retraction force generation element, in particular a coiled portion of the coil spring.

In addition or as an alternative to the spring, the retraction force generation element may comprise or may be formed as a motor, in particular an electric motor, wherein preferably a retraction force output unit of the motor may be coupled to the flexible conduit or a part connected thereto, in particular the retraction force transmitting element, and a basis unit of the motor may be coupled to the holding unit. The retraction force output unit of the motor may be a rotatable drive shaft or the like. The basis unit of the motor, in turn, may be a static part of the motor, such as a motor housing or the like. If the liquid dispensing unit further comprises the above-mentioned a retraction force generation element housing, also the motor, optionally including its motor housing, may be arranged inside the retraction force generation element housing. Furthermore, the motor may be configured to be connected to an electric energy source, such as a power socket, arranged adjacent to the liquid dispensing unit and/or the liquid dispensing apparatus, via electric lines or the like. To adjust the retraction force generated by the motor, the liquid supply unit or the liquid dispensing apparatus may also comprise a control unit which is configured to be operatively connected to the motor and optionally to a user interface, such as a touch screen or the like. As a result, the user may also be able to control an operating mode of the motor, such as a high retraction force operating mode which is configured to generate high retraction forces and/or a low retraction force operating mode which is configured to generate low retraction forces which are preferably lower than in the high retraction force operating mode. The control unit may be further configured to control other functions of the liquid supply unit and/or the liquid dispensing apparatus, such as the dispensing of a specific kind of liquid, such as cold water, warm water, filtered water and/or non-filtered water, an additive, such as syrup, mixed beverages or the like by controlling a valve arrangement comprising one or more valves for controlling a flow of liquid through a liquid supply system of the liquid dispensing apparatus.

To ensure that the holding unit may be mounted to the holding structure in a fast and comfortable manner, the holding unit may be formed as a mounting angle, wherein the mounting angle preferably may be substantially L-shaped. In this context, the mounting angle may preferably have an angle of about 90° which is particular preferably if the holding unit is configured to be mounted to a horizontal or a vertical surface of the holding structure, such as a bottom portion or a wall portion of a kitchen cabinet. In addition or as an alternative, at least one portion of the holding unit may be configured to rotate and/or pivot relative to another portion of the holding unit to adjust an angle between the at least one portion and the other portion. In this context, the at least one portion may be connected to the other portion by a hinge or the like. Furthermore, the holding unit may comprise a sliding mechanism or the like to allow a relative movement between the holding unit and the holding structure, such as the kitchen cabinet.

According to a further embodiment, the liquid retraction mechanism may further comprise a conduit connection unit which is configured to connect the retraction force generation element or a part connected thereto, in particular the retraction force transmitting element, to the flexible conduit, wherein at least one part of the conduit connection unit is rotatably mounted to the flexible conduit. Thus, it is possible, to rotate the at least one part of the conduit connection unit relative to the flexible conduit, while also ensuring a reliable retraction force transmission along the longitudinal direction of the flexible conduit. This is particularly advantageous if the basis element of the liquid dispensing unit is formed as a faucet which is pivotable around a pivot axis by a predetermined pivot angle and/or rotatable around a rotation axis by a full rotation or more, to additionally adjust a liquid dispensing position of the liquid dispensing unit.

In further development of the latter embodiment, the conduit connection unit may comprise an engagement element, in particular a rotating ring hook element, which is configured to allow a rotational movement relative to the flexible conduit and to allow an end portion of the retraction force transmitting element to engage with the conduit connection unit.

To allow easy and reliable mounting of the conduit connection unit to the flexible conduit, the conduit connection unit may further comprise a clamping unit having to opposed clamping halves which are configured to position the engagement element relative to the flexible conduit. The clamping halves may be configured to be connected by one or more fixation elements, such as one or more screws or the like.

In such a case, one of the clamping halves may be formed with respective threaded holes which may be configured to engage with a corresponding screw that is configured to be inserted through a hole of the other of the clamping halves.

To arrange the conduit connection unit on the flexible conduit, the conduit connection unit may further comprise a sleeve which is configured to be fixedly mounted to the flexible conduit. In this context, "fixedly mounted" may be interpreted such that the sleeve is at least not movable in a longitudinal direction of the flexible conduit to ensure reliable transmission of the retraction force.

If the retraction mechanism comprises the above-mentioned retraction force transmitting element as well as the engagement element, to be able to couple the retraction force transmitting element to the engagement element in simple and preferably detachable manner, the end of the retraction force transmitting element, which is coupled to the flexible conduit, may comprise a loop portion, which is configured to engage with the engagement element, in particular the hook element.

Furthermore, the retraction force transmitting element may be formed as a flexible wire, which is preferably configured to be bendable in a direction substantially transversal to its longitudinal direction. Thus, via the retraction force transmitting element, the retraction force may be transmitted in a reliable manner while ensuring a maximum flexibility in terms of the direction in which the retraction force generated by the retraction force generation element is transmitted to the flexible conduit.

To be able to dispense not only one kind of liquid but preferably, at the same time, more than one kind of liquid with the liquid dispensing unit of the present invention, it is further proposed that the pull-out dispensing nozzle comprises at least two, preferably at least three, liquid conduits, wherein preferably the liquid conduits are arranged concentrical to each other. Preferably each liquid conduit may be configured to supply a specific kind of liquid, such as cold water, warm water, filtered water and/or non-filtered water, an additive, such as syrup, mixed beverages or the like.

According to a further aspect, the present invention refers to a liquid dispensing apparatus, comprising the above-described liquid dispensing unit, a liquid supply system having a liquid inlet which is designed and intended to be connected to a liquid source and to receive a liquid from the liquid source, and the dispensing outlet which is designed and intended to be connected to the liquid dispensing unit.

With regard to the effects and advantages of the liquid dispensing apparatus it is explicitly referred to the above statements to the liquid dispensing unit according to the invention. All statements with respect to the liquid dispensing unit also apply for the liquid dispensing apparatus and vice versa.

The liquid supply system of the liquid dispensing apparatus may include different functions for dispensing liquids, such as cold water, warm water, filtered water and/or non-filtered water, an additive, such as syrup, mixed beverages or the like. In this context the liquid supply system may comprise one or more of a cooling unit, a heating unit, a filtering unit and one or more liquid storages, such as a liquid storage for cold water and/or a liquid storage for warm or hot water and/or a liquid storage for filtered water and/or one or more storages for additives, such as syrup or the like. Furthermore, the liquid supply system may comprise a valve arrangement comprising one or more valves for controlling a flow of liquid through the liquid supply system and/or a sensor arrangement including but not limited to one or more temperature sensors and/or pressure sensors and/or filling level sensors or the like.

According to an embodiment, the liquid supply system may be configured to be arranged in a mounting space of the holding structure, wherein the holding structure is preferably an under-sink kitchen cabinet.

Preferred embodiments of the present invention will now be described in more detail with respect to the accompanying drawings, in which:

FIG. 1*a* shows a schematic view of a liquid dispensing apparatus comprising a liquid dispensing unit of the present invention according to an embodiment.

Figure 1B:
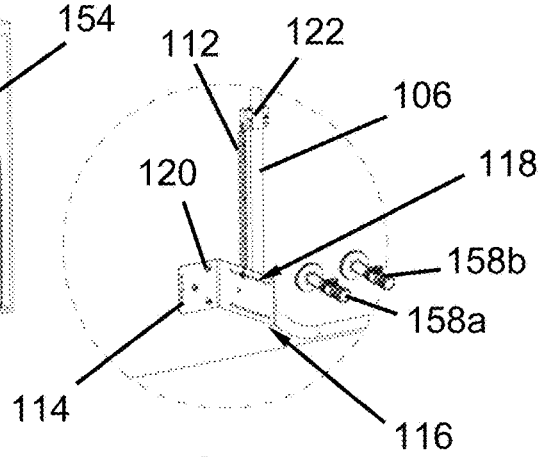
Figure 2A:
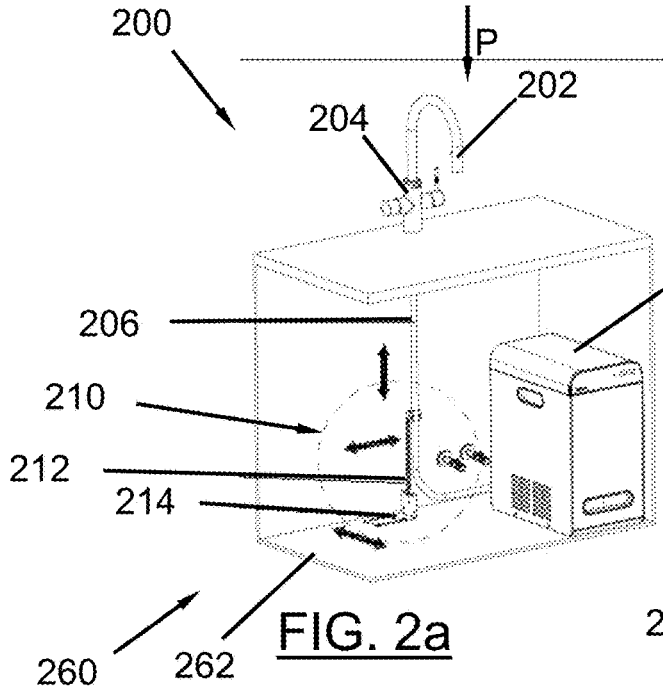
Figure 2B:
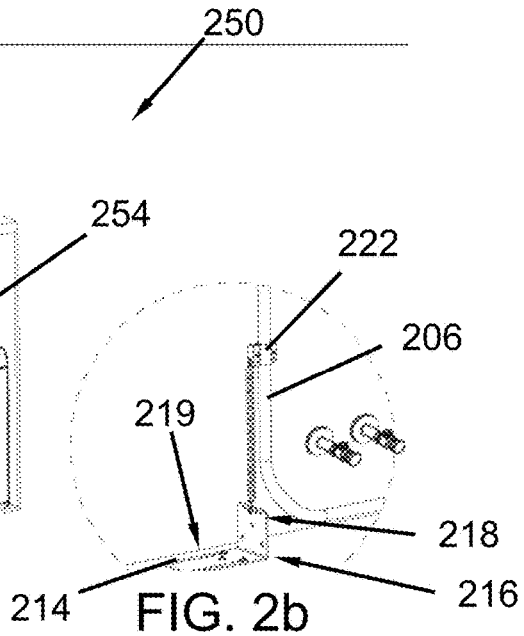
Figure 3A:
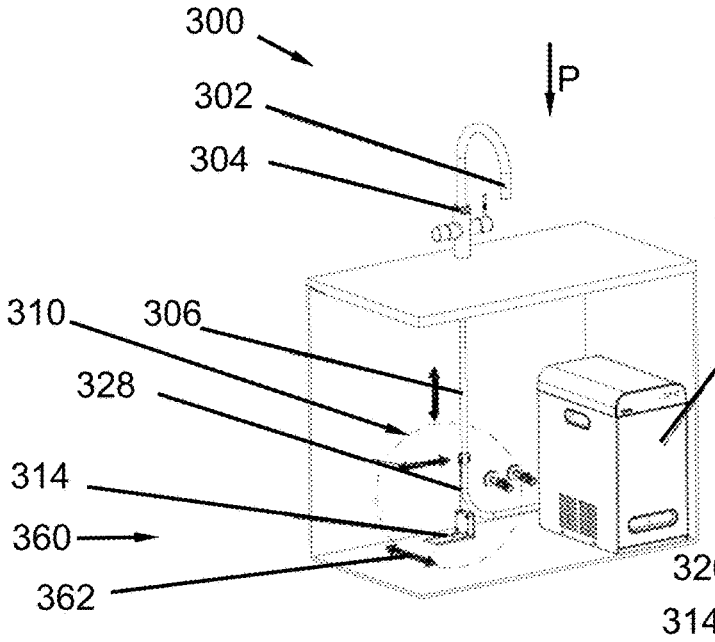
Figure 3B:
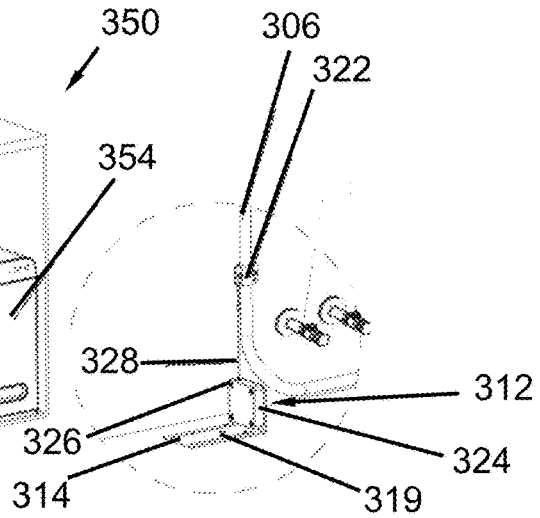
Figure 4A:
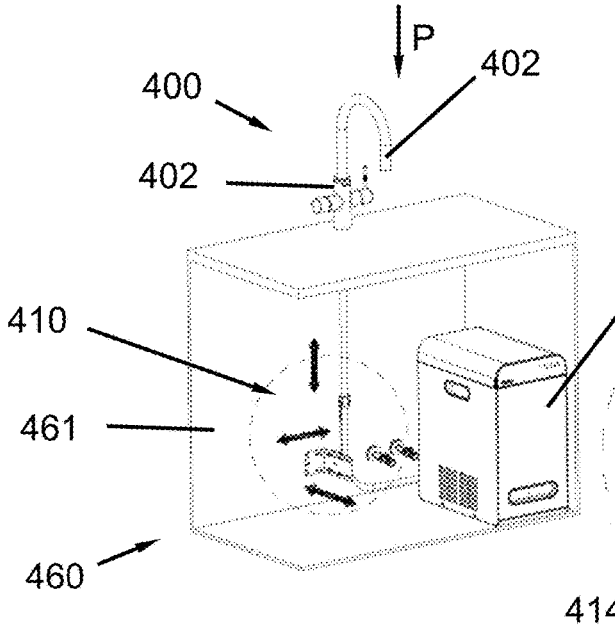
Figure 4B:
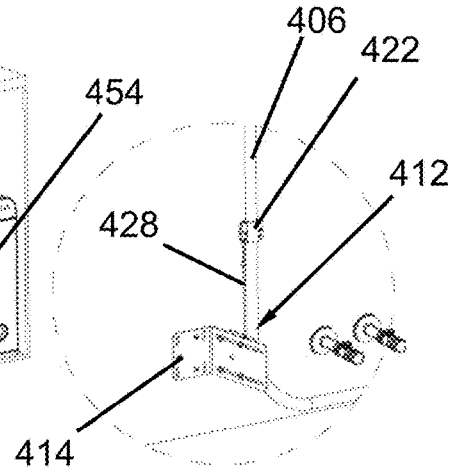
Figure 5A:
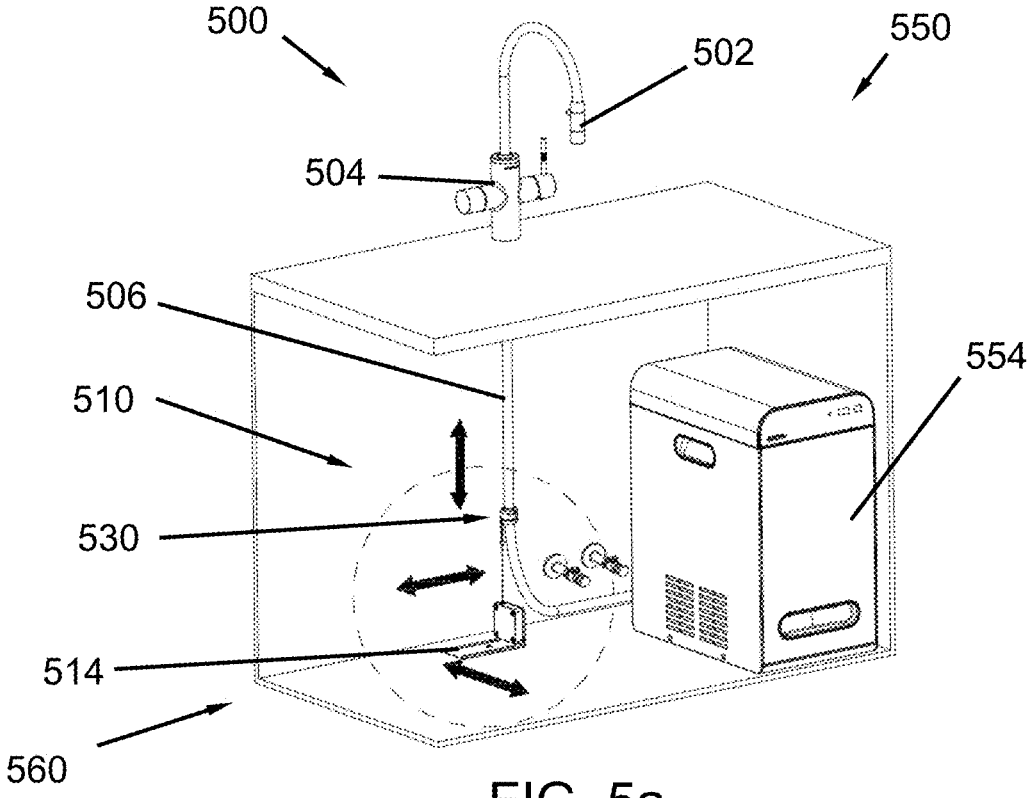
Figure 5B:
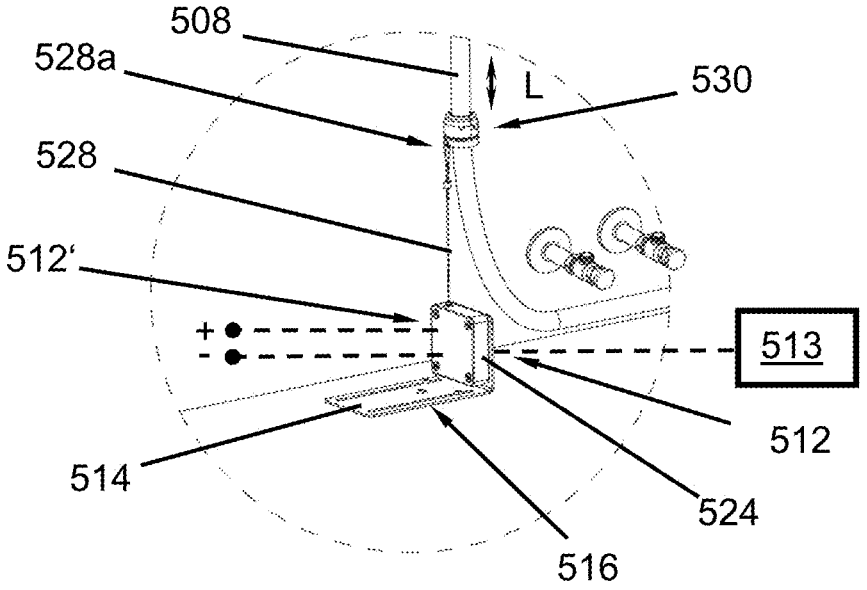
Figure 5C:
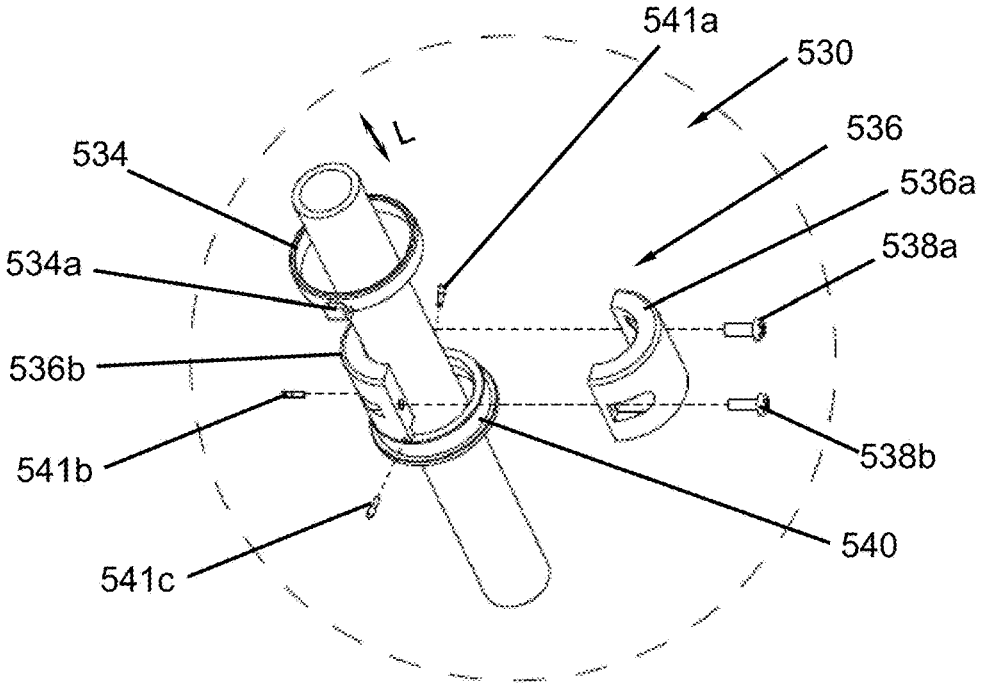
Figure 6A:
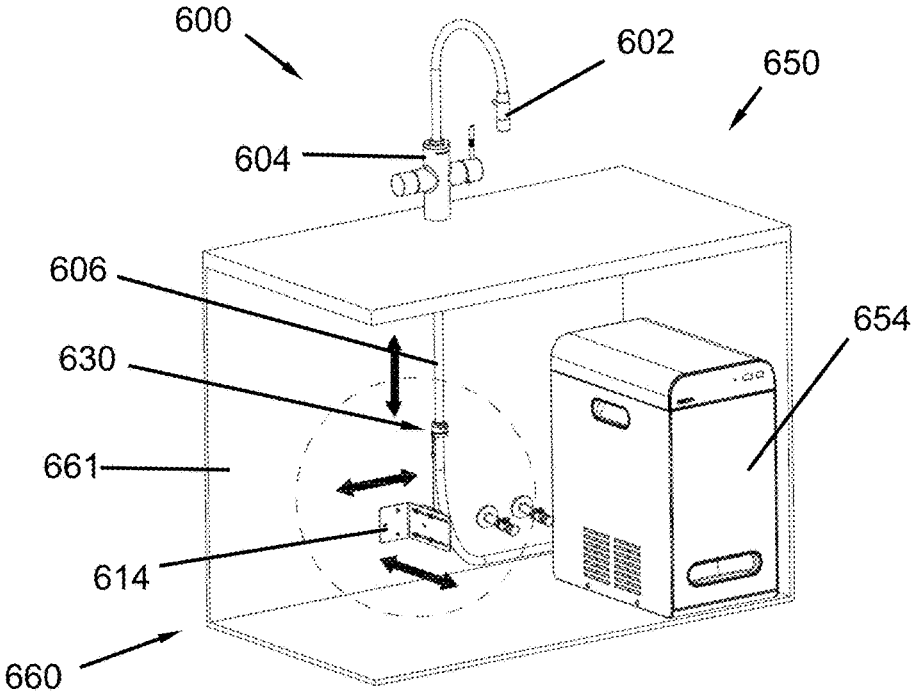
Figure 6B:
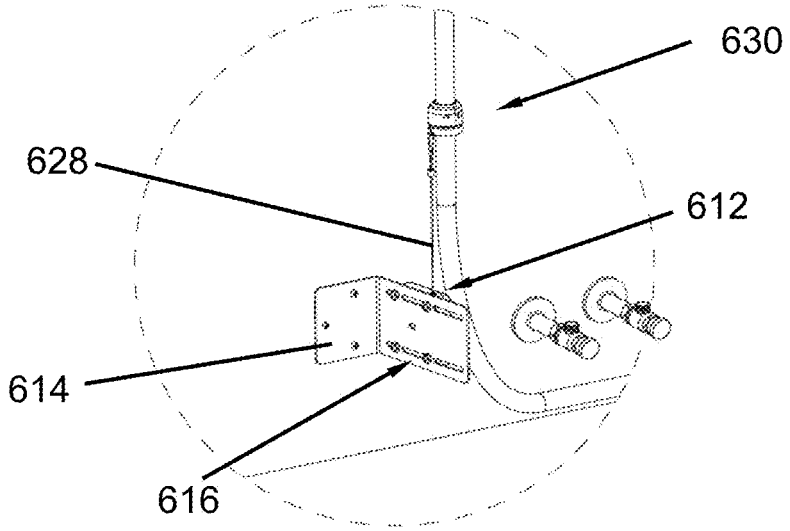
Figure 7:
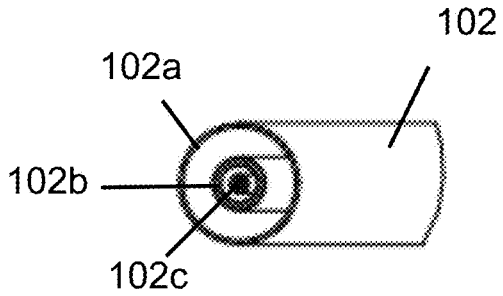

FIG. 1*b* shows an enlarged view of FIG. 1*a*,

FIG. 2*a* shows an embodiment similar to FIG. 1*a*, with a changed mounting position of a holding unit of the liquid dispensing unit, FIG. 2*b* shows an enlarged view of FIG. 2*a*, FIG. 3*a* shows another embodiment which is similar to FIG. 2*a* but comprises another embodiment of a retraction mechanism, FIG. 3*b* is an enlarged view of FIG. 3*a*, FIG. 4*a* shows an embodiment similar to FIG. 3*a* but with a different mounting position of the holding unit, FIG. 4*b* shows an enlarged view of FIG. 4*a*, FIG. 5*a* shows an embodiment similar to FIG. 3*a*, wherein the retraction mechanism further comprises a conduit connection unit which is rotatably mounted to the flexible conduit, FIG. 5*b* shows an enlarged view of FIG. 5*a*, FIG. 5*c* shows an enlarged and exploded partial view of FIG. 5*b*, FIG. 6*a* shows an embodiment similar to FIG. 5*a* but with a different mounting position of the holding unit, FIG. 6*b* shows an enlarged view of FIG. 6*a*, and FIG. 7 shows an embodiment of a pull-out dispensing nozzle of the liquid dispensing unit according to the invention.

In FIG. 1*a* a liquid dispensing apparatus according to an embodiment of the present invention is generally designated by reference sign 150. The liquid dispensing apparatus 150 comprises a liquid dispensing unit 100 which, in the present embodiment, is formed as a so-called pull-out faucet.

The liquid dispensing unit 100 is configured to dispense liquid such as water, in particular filtered water and/or non-filtered water, delivered from a dispensing outlet 152 of a liquid supply system 154 of the liquid dispensing apparatus 150. The liquid dispensing unit 100 therefore comprises a pull-out dispensing nozzle 102 which is configured to be moved in a pull-out direction P relative to a basis element 104 which, in the present embodiment, is formed as a faucet 104. The liquid dispensing unit 100 further comprises a flexible conduit 106 which may be formed as a flexible hose or the like. The flexible conduit 106 is designed and intended to fluidically connect the pull-out dispensing nozzle 102 to the dispensing outlet 152 of the liquid supply system 154.

Furthermore, the liquid dispensing unit 100 comprises a retraction mechanism 110 which is operationally connected to the flexible conduit 106 and configured to apply a retraction force to the flexible conduit 106, in response to the pull-out dispensing nozzle 102 being moved in the pull-out direction P relative to the basis element 104. The retraction mechanism 110 comprises a retraction force generation element 112 which, in the present embodiment, is formed as a linear spring 112. The spring 112 is configured to generate the retraction force to be applied to the flexible conduit 106.

Furthermore, the retraction mechanism 110 comprises a holding unit 114 which is configured to be connected to the spring 112 and configured to be mounted to a holding structure 160. In the present embodiment the holding structure 160 is a wall portion 161 of a kitchen cabinet. However, the embodiment is not limited to being mounted to kitchen cabinets and maybe also used together with other applications and/or similar holding structures.

The holding unit 114 comprises adjustment means 116 which are shown in FIG. 1*b* for example and, in the present embodiment, are formed as a plurality of mounting holes 118 configured to adjust a connecting position between the holding unit 114 and the spring 112.

In the embodiment shown in FIGS. 1*a* and 1*b*, the holding unit 114 is formed as a mounting angle 114 which is substantially L-shaped. The mounting angle 114 may preferably have an angle of about 90°. Furthermore, the mounting angle 114 may be formed of a metal material or of a plastic material or the like. In addition, the holding unit 114 in form of the mounting angle 114 may be connected to the mounting structure 160 by one or more fixation elements 120, which in the embodiment shown in FIG. 1*b* are formed as fixation screws 120.

Via the mounting holes 118, which are arranged at different positions on the holding unit 114, the connecting position between the holding unit 114 and the retraction force generation element 112 in form of the linear spring 112 may be adapted in a manner to influence a direction of the retraction force generated by the linear spring 112 and applied to the flexible conduit 106. The flexible conduit 106 and the spring 112 may be connected via connection element 122 which may be formed as a clamping element 122.

Furthermore, the liquid dispensing apparatus 150 shown in FIGS. 1*a* and 1*b* comprises the liquid supply system 154 having a liquid inlet 156 which is designed and intended to be connected to a liquid source 158, such as a mains water supply or the like, and to receive a liquid from the liquid source 158. In the present embodiment the liquid source 158 comprises two liquid supply conduits, namely a first liquid supply conduit 158*a* for supplying cold water, for example and a second liquid supply conduit 158*b* for supplying hot water, for example. Furthermore, the liquid supply system 154 may comprise the dispensing outlet 152 which may be arranged on a back side (in FIG. 1*a* not shown) of the liquid supply system 154 and may be designed and intended to be connected to the liquid dispensing unit 100, in particular the flexible conduit 106.

FIGS. 2*a* and 2*b* show another embodiment of a liquid dispensing apparatus 250 comprising a liquid dispensing unit 200 which is similar to the liquid dispensing unit 100 shown in FIGS. 1*a* and 1*b* with the exception of the holding unit 214. Thus, in FIGS. 2*a* and 2*b* analogous parts are designated by analogous reference signs but increased by 100. Furthermore, the embodiment shown in FIGS. 2*a* and 2*b* will be described only in so far as it is different from the embodiment shown in FIGS. 1*a* and 1*b*. As shown FIG. 2*b*, for example, the holding unit 214 is also formed as a mounting angle but with a different mounting position to the mounting structure 260, as compared to FIGS. 1*a* und 1*b*, wherein the holding unit 214 is mounted to a bottom portion 262 of the mounting structure 260 in form of the kitchen cabinet 260. Furthermore, the holding unit 214 comprises adjustment means 216 in form of elongated mounting holes 219 to change a mounting position of the holding unit 214 relative to the bottom portion 262 of the cabinet 260 in a substantially horizontal direction. In addition to the elongated mounting holes 219 the holding unit 214 may also comprise the plurality of mounting holes 218 similar to the plurality of mounting holes 118 but by a decreased number.

FIGS. 3*a* and 3*b* show yet another embodiment of a liquid dispensing apparatus 350 including a liquid dispensing unit 300. The embodiment shown in FIGS. 3*a* and 3*b* is similar to the embodiment shown in FIGS. 2*a* and 2*b*. Thus, analogous parts are designated by analogous reference signs but increased by 100. Furthermore, the embodiment shown in FIGS. 3*a* and 3*b* will be only described in so far as it is different from the embodiment shown in FIGS. 2*a* and 2*b* respectively. The liquid dispensing unit 300 comprises a retraction force generation element 312 which is formed as a coil spring 312 which is arranged in a retraction force generation element housing 324 which is configured to house the retraction force generation element 312. The retraction force generation element housing 324 may be detachable attached to the holding unit 314 by one or more fixation screws 326. Similar to FIGS. 2*a* and 2*b*, the holding unit 314 of FIGS. 3*a* and 3*b* is mounted to the bottom portion 362 of the kitchen cabinet 360.

Furthermore, the embodiment shown in FIGS. 3*a* and 3*b* comprises a retraction force transmitting element 328 which on its one end is connected to the retraction force generation element 312 and on its other end is coupled to the flexible conduit 306. The retraction force transmitting element 328 may be formed as a flexible wire, for example. The retraction force transmitting element 328 may be connected to a connection element 322 which may be similar to the connection elements 122 and 222 shown in FIGS. 1*b* and 2*b*, respectively.

The embodiment shown in FIGS. 4*a* and 4*b* is similar to the embodiment shown in FIGS. 3*a* and 3*b*. Thus, analogous parts are designated by analogous reference signs but, as compared to FIGS. 3*a* and 3*b*, increased by 100. Furthermore, the embodiment shown in FIGS. 4*a* and 4*b* will be only described in so far as it differs from the embodiment shown in 3*a* and 3*b*. The embodiment shown in FIGS. 4*a* and 4*b* differs from the embodiment shown in FIGS. 3*a* and 3*b* in that the holding unit 414 is mounted to a wall portion 461 of the kitchen cabinet 460. Furthermore, elongated mounting holes 419 are formed on a portion of the holding unit 414 which faces the retraction force generation element housing 424 of the retraction mechanism 414.

FIGS. 5*a* to 5*c* show yet another embodiment of a liquid dispensing apparatus 550 comprising a liquid dispensing unit 500. The embodiment shown in FIGS. 5*a* to 5*c* is similar to the embodiment shown in FIGS. 3*a* and 3*b*. Thus, analogous parts are designated by analogous reference signs but, as compared to FIGS. 3*a* and 3*b*, increased by 200. Furthermore, the embodiment shown in FIGS. 5*a* to 5*c* will be only described in so far as it differs from the embodiment shown in FIGS. 3*a* and 3*b*. A special feature of the embodiment shown in FIGS. 5*a* and 5*b* is that the retraction mechanism 510 comprises a conduit connection unit 530 which is configured to connect the retraction force generation element 512, or in the present embodiment the retraction force transmitting element 528, to the flexible conduit 506. The conduit connection unit 530 is at least in part rotatably mounted to the flexible conduit 506. Thus, it is possible to rotate the conduit connection unit 530 relative to the flexible conduit 506, while also ensuring a reliable retraction force transmission along a longitudinal direction L of the flexible conduit 506.

In addition or as an alternative to the spring mentioned above, the retraction force generation element may comprise or may be formed as a motor 512', in particular an electric motor, which is indicated by reference sign 512' in FIG. 5*b*. Preferably a retraction force output unit (not shown) of the motor 512', such as a drive shaft, may be coupled to the retraction force transmitting element 528. Furthermore, the motor 512' may be arranged inside the retraction force generation element housing 524. To adjust the retraction force generated by the motor 512', the liquid dispensing apparatus 550 may also comprise a control unit 513 which is configured to be operatively connected to the motor 512', as indicated by dotted lines in FIG. 5*b*. Furthermore, the motor 512' may be configured to be connected to an electric energy source, such as a power socket (indicated by "+" and "−"), arranged adjacent to the liquid dispensing apparatus 550, via electric lines as also indicated by dotted lines in FIG. 5*b*.

In FIG. 5*c* the conduit connection unit 530 is shown in more detail. The conduit connection unit 530, according to the present embodiment, comprises an engagement element 534 which, in the present embodiment, is formed as a rotating ring hook element 534, and which is configured to allow the rotational movement between the flexible conduit 506 and the conduit connection unit 530. The engagement element 534 is configured to allow an end portion 528*a* (as shown in FIG. 5*b*), such as a loop portion of the retraction force transmitting element 528, to engage with the conduit connection unit 530 at a hook portion 534*a* of the engagement element 534.

To allow easy and reliable mounting of the conduit connection unit 530 to the flexible conduit 506, the conduit connection unit 530 may further comprise a clamping unit 536 having two opposed clamping halves 536*a* and 536*b* which are configured to position the engagement element 534 relative to the flexible conduit 506. The clamping halves 536*a* and 536*b* may be connected to each other by one or more fixation elements, such as fixation screws 538*a* and 538*b*.

To arrange the conduit connection unit 530 on the flexible conduit 506, the conduit connection unit 530 may further comprise a sleeve 540 which is configured to be fixedly mounted to the flexible conduit 506 by the clamping halves 536*a* and 536*b*. Furthermore, the clamping halves 536*a* and 536*b* may be connected to the sleeve 540 by connecting pins 541*a*, 541*b* and 541*c*. Furthermore, the connecting pins 541*a*, 541*b* and 541*c* may optionally restrict movement of the engagement element 543 in and/or against the longitudinal direction L of the flexible conduit 506.

FIGS. 6*a* and 6*b* show another embodiment of a liquid dispensing apparatus 650 comprising a liquid dispensing unit 600. The embodiment shown in FIGS. 6*a* and 6*b* is similar to the embodiment shown in FIGS. 5*a*-5*c*. Thus, analogous parts are designated by analogous reference signs but increased by 100. Furthermore, the embodiment shown in FIGS. 6*a* and 6*b* will be only described in so far as it differs from the embodiment shown in FIGS. 5*a* to 5*c*. As shown in FIGS. 6*a* and 6*b*, the holding unit 614 is arranged at a wall portion 661 of the kitchen cabinet 660 similar to the embodiment shown in FIGS. 4*a* and 4*b*. However, the conduit connection unit 630 may be very similar or exactly the same as the conduit connection unit 530.

Finally, FIG. 7 shows an enlarged view of the pull-out dispensing nozzle 102 shown in FIG. 1*a*. As shown in FIG. 7, the pull-out dispensing nozzle 102 comprises three liquid conduits, namely a first liquid conduit 102*a*, a second liquid conduit 102*b* and a third liquid conduit 102*c* which are arranged concentrical to each other. It should be noted that the pull-out dispensing nozzle 102 shown in FIG. 7 may be combined with all embodiments shown in FIGS. 1*a*-6*b*.

Furthermore, it should be added that with retraction mechanisms 110, 210, 310, 410, 510 and 610 including the holding units 114, 214, 314, 414, 514 and 614 as well as their corresponding adjustment means it is preferably possible to adjust a retraction force acting on the flexible conduit in all three spatial directions, as indicated by respective arrows in FIGS. 1*a*, 2*a*, 3*a*, 4*a*, 5*a* and 6*a*.

The invention claimed is:

1. Liquid dispensing unit which is configured to dispense liquid delivered from a dispensing outlet of a liquid dispensing apparatus to an outside of the liquid dispensing unit, the liquid dispensing unit comprising:

a pull-out dispensing nozzle which is configured to be moved in a pull-out direction and opposite thereto relative to a basis element of the liquid dispensing unit;

a flexible conduit which is designed and intended to fluidically connect the pull-out dispensing nozzle to the dispensing outlet of the liquid dispensing apparatus; and a retraction mechanism which is operationally connected to the flexible conduit and configured to apply a retraction force to the flexible conduit, in response to the pull-out dispensing nozzle being moved in the pull-out direction relative to the basis element, wherein the retraction mechanism comprises:

a retraction force generation element, which is configured to generate the retraction force to be applied to the flexible conduit; and a holding unit which is configured to be connected to the retraction force generation element and configured to be mounted to a holding structure, wherein the holding unit comprises adjustment means configured to adjust a mounting position of the holding unit relative to the holding structure and/or to adjust a connecting position between the holding unit and the retraction force generation element and wherein the retraction mechanism further comprises a conduit connection unit which is configured to connect the retraction force generation element or a part connected thereto to the flexible conduit, wherein at least one part of the conduit connection unit is rotatably mounted to the flexible conduit; and wherein the conduit connection comprises an engagement element, which is configured to allow a rotational movement relative to the flexible conduit and to allow an end portion of the retraction force transmitting element to engage with the conduit connection unit.

2. Liquid dispensing unit according to claim 1, wherein the adjustment means comprise a plurality of mounting holes.

3. Liquid dispensing unit according to claim 1, wherein the retraction mechanism further comprises:

a retraction force transmitting element which on its one end is connected to the retraction force generation element and on its other end is coupled to the flexible conduit, wherein the retraction force transmitting element is configured to transmit the retraction force generated by the retraction force generation element to the flexible conduit.

4. Liquid dispensing unit according to claim 1, wherein the retraction force generation element comprises or is formed as a spring, wherein one end of the spring is coupled to the flexible conduit or a part connected thereto, and the other end of the spring is coupled to the holding unit, and/or wherein the retraction force generation element comprises or is formed as a motor.

5. Liquid dispensing unit according to claim 1, wherein the retraction mechanism further comprises a housing which is configured to house the retraction force generation element.

6. Liquid dispensing unit according to claim 1, wherein the holding unit is formed as a mounting angle.

7. Liquid dispensing unit according to claim 1, wherein the conduit connection unit further comprises a clamping unit having to opposed clamping halves which are configured to position the engagement element relative to the flexible conduit.

8. Liquid dispensing unit according to claim 1, wherein the conduit connection unit further comprises a sleeve which is configured to be fixedly mounted to the flexible conduit.

9. Liquid dispensing unit according to claim 1, wherein the retraction mechanism further comprises:

a retraction force transmitting element which on its one end is connected to the retraction force generation element and on its other end is coupled to the flexible conduit, wherein the retraction force transmitting element is configured to transmit the retraction force generated by the retraction force generation element, and wherein the end of the retraction force transmitting element which is coupled to the flexible conduit comprises a loop portion which is configured to engage with the engagement element.

10. Liquid dispensing unit according to claim 1, wherein the retraction force transmitting element is formed as a flexible wire.

11. Liquid dispensing unit according to claim 1, wherein the pull-out dispensing nozzle comprises at least two liquid conduits.

12. Liquid dispensing apparatus comprising:

the liquid dispensing unit according to claim 1; and a liquid supply system having a liquid inlet which is designed and intended to be connected to a liquid source and to receive a liquid from the liquid source, and the dispensing outlet which is designed and intended to be connected to the liquid dispensing unit.

13. Liquid dispensing apparatus according to claim 12, wherein the liquid supply system is configured to be arranged in a mounting space of the holding structure.

14. Liquid dispensing unit according to claim 1, wherein the basis element is a faucet.

* * * * *